US005584410A

United States Patent [19]

Siblik

[11] Patent Number: 5,584,410

[45] Date of Patent: Dec. 17, 1996

[54] DRUM CLOSURE ASSEMBLY

[75] Inventor: Allen D. Siblik, Wadworth, Ill.

[73] Assignee: Hallen Products Ltd., Wadsworth, Ill.

[21] Appl. No.: 377,149

[22] Filed: Jan. 24, 1995

[51] Int. Cl.[6] ..... B65D 45/32

[52] U.S. Cl. ..... 220/320; 292/256.67; 411/145; 411/146; 411/353

[58] Field of Search ..... 220/319, 320; 215/274, 275; 292/256.6, 256.67, 299; 411/143, 144, 145, 146, 352, 353, 959

[56] References Cited

U.S. PATENT DOCUMENTS

| | | | |
|---|---|---|---|
| 1,106,248 | 8/1914 | Simpson | 411/145 |
| 1,210,758 | 1/1917 | Brand | 411/146 X |
| 1,377,397 | 5/1921 | Chance | 411/146 X |
| 1,537,478 | 5/1925 | Lipke | 411/146 |
| 1,957,923 | 5/1934 | Wilcox . | |
| 1,969,120 | 8/1934 | Coakley . | |
| 2,002,671 | 5/1935 | McLaughlin . | |
| 2,017,493 | 10/1935 | Glowacki . | |
| 2,087,053 | 7/1937 | Stoll . | |
| 2,226,396 | 12/1940 | Wackman . | |
| 2,603,382 | 7/1952 | Kojan . | |
| 2,633,616 | 4/1953 | Kohout . | |
| 2,889,018 | 6/1959 | Swan . | |
| 2,968,508 | 1/1961 | Campbell et al. . | |
| 3,022,103 | 2/1962 | Klygis . | |
| 3,346,139 | 10/1967 | Armstrong, Jr. | 220/320 |
| 3,417,802 | 12/1968 | Oldenkott . | |
| 3,447,825 | 6/1969 | Santoni | 220/320 X |
| 3,803,667 | 4/1974 | Rose . | |
| 3,907,349 | 9/1975 | Kane . | |
| 4,034,788 | 7/1977 | Melone . | |
| 4,134,609 | 1/1979 | Santoni . | |
| 4,195,678 | 4/1980 | Pinchback . | |
| 4,200,316 | 4/1980 | Kennedy . | |
| 4,792,056 | 12/1988 | Tiernan . | |
| 4,957,317 | 9/1990 | Jakubas . | |
| 4,982,864 | 1/1991 | Kusta . | |
| 5,193,864 | 3/1993 | Coleman . | |
| 5,215,206 | 6/1993 | Siblik . | |
| 5,259,715 | 11/1993 | Harle . | |

*Primary Examiner*—Stephen K. Cronin
*Attorney, Agent, or Firm*—McCaleb, Lucas & Brugman

[57] ABSTRACT

An annular closure ring for securing a cover in sealed relation over the open upper end of a cylindrical storage drum or similar container is disclosed in which a split ring is closed about the periphery of the drum and its cover by tightening a headed tie bolt between a pair of laterally spaced lugs fixed to the split ring on opposite sides of the split therein; one of the lugs having a threaded opening therethrough for engagement with the threaded body of a headed tie bolt and the other lug having an enlarged opening therethrough for free passage of the bolt body. The non-threaded lug has parallel lateral faces formed with outwardly projecting teeth bordering the opening therethrough for locking engagement with the underside of the tie bolt head and an opposing jam nut which engages such lug opposite the bolt head; the jam nut being threadingly mounted on the tie bolt between the two lugs and having an axially protruding annular conical guide surface for frictionally engaging an opposing conical chamfer formed about an opposing end of the opening in the non-threaded lug whereby to locate and hold the bolt coaxially within the enlarged opening of the non-threaded lug with adjacent end faces of said nut lockingly engaging the projecting teeth of the non-threaded lug.

9 Claims, 2 Drawing Sheets

DRUM CLOSURE ASSEMBLY

This invention is directed to closure assemblies for securing lids or covers over the open head end of generally cylindrical storage drums used for storing and transporting bulk materials and more particularly to an improved closure assembly capable of maintaining sealed closure between a drum and lid under severe impact forces.

BACKGROUND OF THE INVENTION

Storage drums of the type to which this invention pertains are commonly employed by industry because they are relatively easy to clean and normally are reusable. In general, such drums have a semi-cylindrical bead rim about their upper ends and closure lids having a mating peripheral lip which fit over the drum bead and an intervening gasket seal. An annular split metal closure ring is posed over the lid's lip and drum bead and then compressed radially to bring the ends of the ring in near abutting relation to secure the lid in place and compress the gasket seal. This effects a seal between the drum and lid. Typically a pair of locking lugs or clamp members are welded to the ring, one on either side of the split therein, so that they extend substantially radially outwardly of the ring. The mounted lugs or clamps have openings for passage of a tie bolt therethrough. In some instances, a threaded nut is associated with one of the lugs to engage the outer end of a threaded tie bolt and in other instances the opening in that lug is internally threaded to engage the bolt threads. In either instance, preferably the opening in the other lug is enlarged and unthreaded for free passage of the tie bolt. Appropriate threaded movement of the bolt serves to tighten the bolt connection between the lugs and coaxially align the lug openings to accordingly compress the ring and effect the sealed connection between the lid and drum.

Because the lugs in such closure assemblies protrude radially from the exterior of the annular ring and must align parallel or nearly so when the ring is closed, it is essential when the open ring is mounted for closure over the lid's lip and drum bead that the tie bolt have adequate radial clearance to align with and engage the threads associated with the second lug. Thus, the need for a larger diameter opening through the unthreaded lug. As the tie bolt is tightened, the two lugs approach one another to assume a parallel condition when the ring is closed. This typical closed condition creates an undesirable radial clearance between the body of the bolt and the walls of the opening through the unthreaded lug.

Recently, new packaging standards have been adopted by the United Nations requiring compliance with certain vibration, drop and hydrostatic tests to insure that drum containers of the order to which this invention pertains remain secure and leak proof during transit. However, because of the excess radial clearance between the tie bolt and the enlarged opening through the one unthreaded lug as above outlined, the ends of the closed split ring are prone to radial separation and movement under impact. This results in ring distortion and seal failure in most instances causing leakage, ultimate container failure and possible contamination of its contents.

The present invention is addressed to a solution of the aforedescribed problem.

SUMMARY OF THE INVENTION

This invention presents an improved combination of elements over that taught in my prior U.S. Pat. No. 5,215, 206, issued Jun. 1, 1993, incorporated by reference herein.

In brief, this invention is directed to an improved drum closure assembly of the type employing an annular split metal ring having a pair of outwardly projecting locking lugs affixed thereto on opposite sides of the split ring's opposing ends. The two lugs are assembled on the ring to coaxially align central openings therein for passage of a tie bolt along an axis paralleling the ring when the latter is in closed condition. Tightening of the bolt draws the ends of the ring together to secure the same about the head of the drum. In its preferred form, one of the lugs has an enlarged transverse opening for the free passage of a headed tie bolt therethrough while the opening in the other lug is threaded to engage the threaded body of the tie bolt. Formed about the circumference of the opening in the one unthreaded lug so as to project outwardly of at least one lateral face thereof are a series of axially protruding disruptions or sharp teeth designed to underengage the bolt head in a manner permitting bolt rotation in one direction (tightening) while opposing, reverse rotation thereof. Thus, when the tie bolt is tightened between the two lugs to close the split ring, loosening or backing off of the bolt with consequent unwanted expansion of the ring is substantially prevented. Preferably, opposite sides or faces of the unthreaded lug are provided with such locking protrusions, aligned in directions so that the lug may be used with bolts installed from either the right hand or left hand side of the assembly as selected.

To prevent unwanted radial movement between the non-threaded lug and the tie bolt when the split ring is closed, a threaded jam nut is mounted on the bolt between the two lugs. The jam nut if formed with an annular tapered or conical projection extending axially outwardly of at least one end face thereof for engaging a mating conical chamfer formed about an opposing end of the enlarged opening in the non-threaded lug. When the jam nut is tightened against the conical chamfer, the end face of the jam nut engages and locks with the sharp teeth on the adjacent face of the unthreaded lug and the conical projection serves to take up the slack between the diameter of the opening and the body of the bolt passing through the unthreaded lug. In order to provide for selected left or right hand bolt insertion, both end faces of the jam nut preferably are formed with a tapered projection and the non-threaded lug is provided with mating chamfers about both ends of the opening therethrough.

It is a primary object of this invention to provide an improved split-ring closure assembly for use with storage drums which comprises bolt receptive locking lugs structured to hold the tightened tie bolt in ring compressing position and a conically faced jam nut engageable with one of the lugs for preventing relative radial movement between the bolt and said one lug.

It is another important object of this invention to provide an improved storage drum closure ring assembly which is operable to prevent disruption of sealed relation between the drum cover and drum in the presence of impact forces.

A still further important object of this invention is to provide an improved, simple and economical split-ring drum closure assembly having means for preventing seal disruptive movement of the installed ring.

Another important object of this invention is to provide a locking lug for use with a tie bolt in a drum closure assembly which is capable of rotatably locking both left and right hand installed tie bolts and jam nut means against unwanted rotation.

A still further object of this invention, is to provide a closure ring assembly comprising tie bolt receptive lugs wherein an unthreaded one of the lugs is provided with facial locking projections capable of positively interfering engagement with the head of the tie bolt upon reverse rotation thereof and which also positively locks with jam nut means for preventing radial movement of the closure ring and lugs under radial impact forces.

Having described this invention the above and further objects, features and advantages thereof will be recognized from the following description of a preferred embodiment thereof illustrated in the accompanying drawings and representing the best mode presently contemplated for enabling those skilled in the art to practice this invention.

IN THE DRAWINGS

DESCRIPTION OF THE PREFERRED EMBODIMENT

Figure 1:
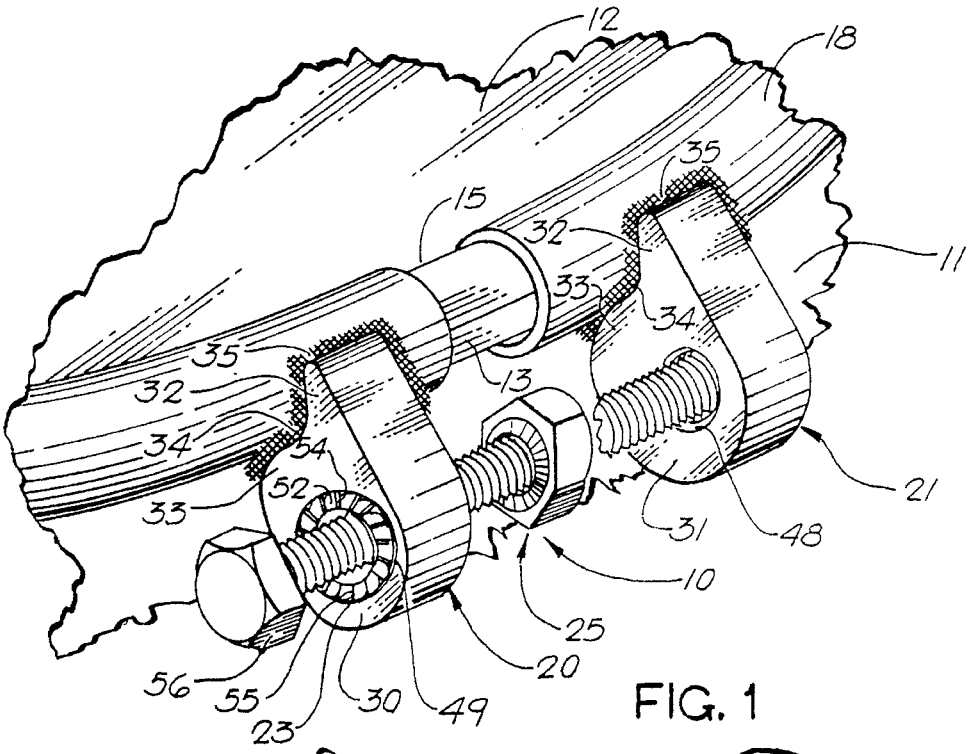
FIG. 1 is a partial exploded perspective view of a drum, drum cover and closure assembly embodying the present invention.
Figure 2:
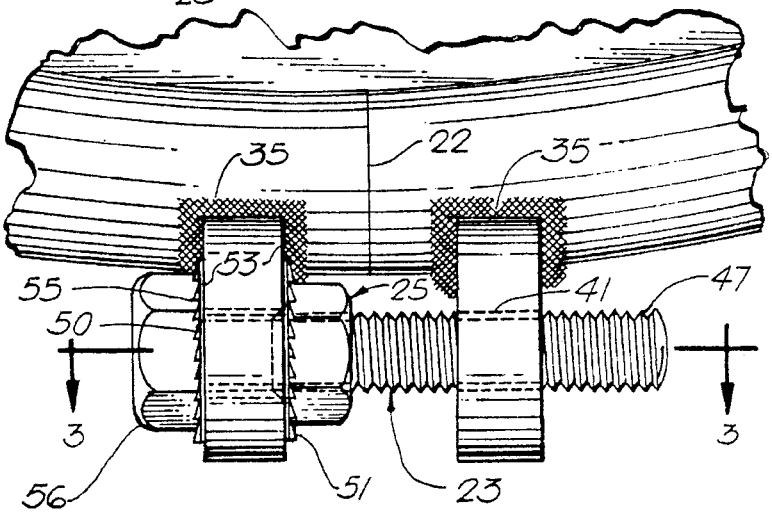
FIG. 2 is an enlarged top plan view of the closure assembly shown in FIG. 1 and illustrating the condition of parts thereof when the closure assembly is in closed condition.

Referring first to FIGS. 1 and 2 of the drawings, it will be recognized that a closure ring assembly, indicated generally at 10 thereat, is mountable about the open upper end of a conventional cylindrical storage drum 11 which is adapted to be closed over by a cover or lid 12. Drum 11 has a rolled annular peripheral bead rim 13 formed about its peripheral upper end and a compressible gasket is normally fitted between the upper side of rim 13 and the under concave side of an annular rolled lip 15 formed about the periphery of cover 12, all as described more fully in my aforementioned U.S. Pat. No. 5,215,206.

Assembly 10 serves to lock the cover 12 to the drum's bead rim While compressing the sealing gasket between that rim and the cover's lip 15. The improved assembly 10 hereof comprises an annular split metal ring 18 of generally arcuate semi-circular transverse cross section. A pair of laterally extending rigid locking lugs 20, 21 are fixed to the ring in positions spaced laterally and on opposite sides of the opposing ends of the ring 18 which are separated by the ring split indicated generally at 22 in FIG. 2 of the drawings. The two lugs extend substantially radially of the ring and preferably depend angularly therefrom in the manner illustrated in FIG. 1. Closure of the ring is affected by means of a hex-headed tie bolt 23 which extends between and cross connects the two lugs 20, 21; the tie bolt 23 being threaded through a jam nut 25 located between the two lugs.

Preferably lugs 20, 21 are made as integral forged metal structures, although, other methods of manufacture may be resorted to. For instance, fabricated lugs made by stamping and formed sheet metal are known and are especially adapted to light load applications. In either event the herein illustrated lugs 20, 21 have like generally cylindrical body portions 30, 31, respectively with integral spaced weld ears 32, 33 protruding tangentially from the upper end of the body portions 30, 31. A concave surface 34 extends between each pair of the weld ears 32, 33 to fit closely with the exterior of closure ring 18. When the lugs are fastened to the closure ring, preferably welded connections 35 extend across the top and bottom edges thereof, as well as along their opposite sides (see FIG. 2).

Figure 3:
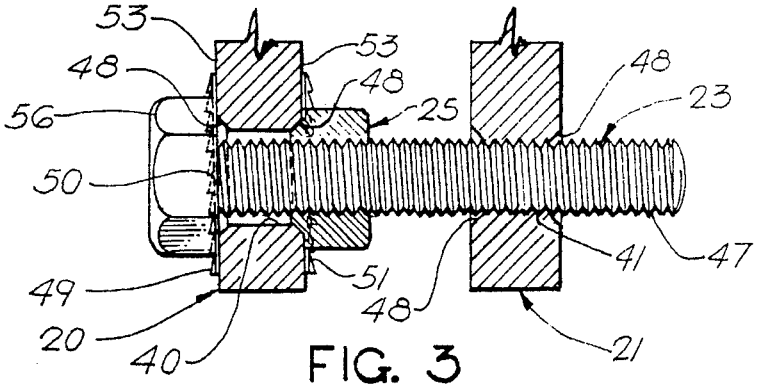
FIG. 3 is a cross sectional view taken substantially along vantage line 3—3 of FIG. 2, looking in the direction of the arrows thereon.

In addition to the described weld lugs, the body portions of the lugs 20, 21 have central cylindrical openings passing transversely therethrough as indicated at 40, 41, respectively (see FIGS. 2 and 3). These openings accommodate passage of the tie bolt 23 whereby the two lugs may be drawn toward one another and into substantially parallel positions when closing the ring 18.

It is important to note that the opening 40 in lug 20 preferably is smooth bored and of a diameter sufficiently large to permit free passage of the tie bolt therethrough and alignment of the bolt with the opening in lug 21. On the other hand, opening 41 in lug 21 preferably is internally threaded to present mating threads to the exterior threads 46 of the tie bolt. Thus appropriate thread advancing rotation of the bolt 23 serves to tighten the ring 18 about the lip 15 of the drum cover thereby compressing the seal against the drum rim 13 when ring 18 is closed as shown in FIG. 2.

In order to assist bolt entry and guide the tie bolt into the lug openings, the opposite outer ends of openings 40 and 41 are suitably chamfered inwardly as indicated at 48 in FIGS. 1 and 3. Additionally, it will be recognized that the planar lateral side faces of the non-threaded lug 20 are formed with annular raised and axially outwardly extending shoulders 49 which border the bolt passage opening 40. The outer faces of these shoulder formations are distinguished by a plurality of novel axially extending sharp teeth or projections 50, 51 (see FIGS. 2 and 3).

Each projection 50, 51 is formed by a planar arcuately extending surface 52 which extends axially outwardly at an angle to the formational plane of the associated raised shoulder 49 to intersect planar side walls 53 of lug 20. Such surfaces 52 terminate at their arcuately outer ends in transversely related surfaces 54 (see FIG. 1) to form sharp chiseled tooth edges 55. Importantly, the projections formed by surfaces 52 and 54 are appropriately formed and oriented on both faces of the locking lug 20 to permit passage of the underface of the bolt head 56 thereover whereby such head overrides the sharp edges 55 in response to clockwise or right handed threaded movement of the bolt. Conversely, counter-clockwise rotation of the bolt, once it is tightened to affect clamping action of the ring 18, is positively resisted by engagement of the sharp teeth 55 with the bolt underside of the head. This relationship also holds true for both left and right hand use positions of the lug 20. Of course, if the tie bolt has a left handed thread, orientation of the projections formed by the surfaces 52 and 54 will be reversed accordingly.

It will be understood, particularly from FIG. 2, that lug 20, being provided with locking teeth on opposite sides of both of its lateral faces is suited for either left hand insertion of the tie bolt or right hand insertion thereof by merely reversing the positions of the lugs from that illustrated in FIGS. 1-3. Consequently, depending on use requirements, the same lug 20 may be used to cover both left hand and right hand type installations. The presence of locking teeth on the bolt head engaging surfaces of the lug 20 in the closure ring assembly hereof, provides a convenient and operably efficient means for substantially preventing loosening of the installed closure ring assembly.

It will be recognized that the aforedescribed assembly 10 embodies the anti-rotational bolt locking teachings and advantages of the closure assembly set out in my above identified U.S. Pat. No. 5,215,206 except for the presence of the novel jam nut 25; the purpose and features of which will now be described more fully.

As previously related, even with the improved drum closure assembly of my prior U.S. Pat. No. 5,215,206 which prevents undesired reverse rotation of the tie bolt, torquing of the tie bolt 23 sufficiently to securely lock the split ring 18 in place about the periphery of the drum and lid, as described, fails to prevent unwanted radial and circumferential movement and distortion of the split ring leading to consequent failure of the sealed integrity of the drum in the presence of heavy or severe impact forces on the split ring or closure assembly. Radial movement of the ring is particularly likely to result if sufficient impact forces occur or adjacent to either of the lugs 20, 21 which will cause the tie bolt to move radially within the large opening 40 of the unthreaded lug 20. Likewise, impact on either of the lugs, even though the ring is closed, is also prone to distort the ring and cause momentary circumferential movement of the unthreaded lug relative to the tie bolt. This too may result in either or both radial or circumferential movement of the split ring.

Figure 5:
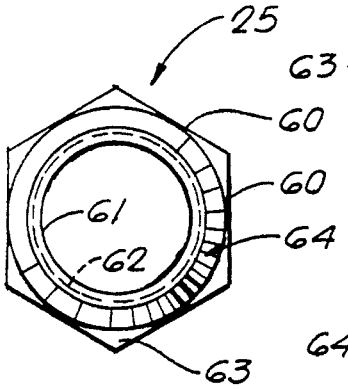
FIG. 5 is a left hand elevational view thereof.
Figure 4:
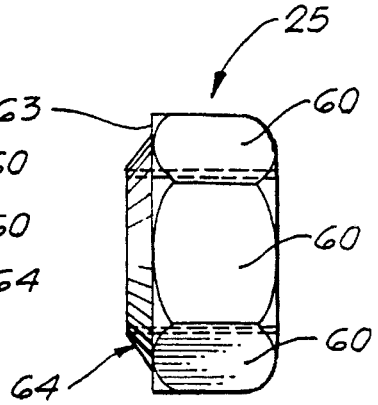
FIG. 4 is a side elevational view of a lock nut illustrated in FIGS. 1—3 of the drawings.
Figure 6:
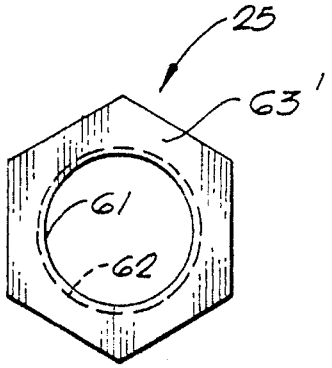
FIG. 6 is a right hand elevational view thereof.

By providing the cone faced jam nut 25 in the described closure assembly according to this invention, the mounted assembly is capable of withstanding impact forces without radial or circumferential movement or distortion of the split ring due to the fact that the tie bolt 23 is positively secured coaxially of the opening 40 in the unthreaded lug. As best shown in FIGS. 4–6 of the drawings, the jam nut 25 comprises a hexagonal exterior providing wrench engaging surfaces 60 on its periphery and a central axial opening 61 having threads 62 for engagement with the external threads 47 of the tie bolt 23.

Importantly, at least one planar end face 63 of nut 25 is formed with an annular axially extending cone 64 bordering the periphery of opening 61 as shown in FIGS. 4 and 5. The outer surface of cone 64 is formed at an angle matingly engageable with an opposing chamfer 48 formed inwardly about the ends of the opening 40 in lug 20 and is operationally threaded onto threads 47 of the tie bolt so as to be positioned between lugs 20 and 21 in operation.

Once the tie bolt is tightened between the two lugs 20 and 21, as above related, to close and clamp the split ring about the drum's bead rim 13 and lip 15 of the cover, threading the jam nut cone 64 into compressive engagement with an opposing recessed chamfer 48 in the unthreaded lug 20, serves to center the tie bolt coaxially of opening 40 therein and prevent movement of the bolt radially of opening 40. At the same time, the planar areas of the nut face 63 radially bordering cone 64, will be engaged by the sharp teeth 51 protruding from the opposing face 53 of lug 20 to lock the jam nut against reverse (loosening) rotation. Thus, the closure assembly is substantially unified against unwanted axial or radial relative movement of lugs 20 and 21 according to that objective of this invention.

Inasmuch as the unthreaded lug 20 may be positioned for either right or left hand bolt insertion, by reversing the positions of lugs 20 and 21 from that shown in FIGS. 1–3 of the drawings, jam nut 25 is accordingly operable against either face 53 of lug 20.

Figure 8:
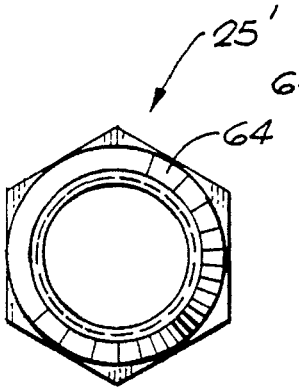
FIG. 8 is a left hand side elevational view thereof.
Figure 7:
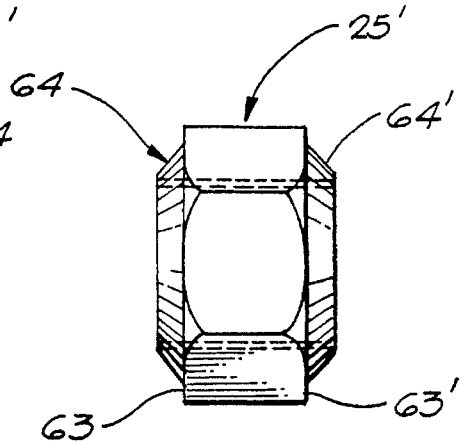
FIG. 7 is a side elevational view of a modified lock nut having two conical guide surfaces on opposite ends thereof.
Figure 9:
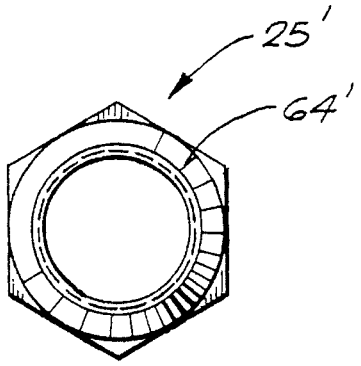
FIG. 9 is a right hand side elevational view thereof.

For convenience in assembly with the tie bolt 23, it is contemplated that jam nut 25 may be formed with a projecting cone on both lateral ends or faces thereof, thereby eliminating the need for properly orienting the jam nut on bolt 23. Such a modified jam nut 25' is illustrated in FIGS. 7–9 which in addition to cone 64 has a second cone 64' extending axially from a second planar face 63' of the jam nut. This dual cone modified nut of course is operable as the aforedescribed single cone jam nut 25 of FIGS. 4–6.

From the foregoing it is believed those familiar with the art will readily understand and recognize the improved advancement of the inventive combination hereof over the prior art and will appreciate that while the same has been herein described and illustrated in association with a preferred embodiment thereof, the same is susceptible to change, modification and substitution of equivalents without departing from the spirit and scope of the invention which is intended to be unlimited by the herein set forth disclosure except as may appear in the following appended claims.

The embodiments of the invention in which an exclusive property or privilege is claimed are defined as follows:

1. A closure assembly for securing a circular drum cover having an annular peripheral lip over an annular bead rim formed about the open end of a cylindrical storage drum, comprising:

an annular split ring having a transverse contour operable to matingly overfit the annular peripheral lip of the drum cover;

pair of laterally spaced, first and second depending lugs extending outwardly from said ring on opposite sides of the split therein;

each of said lugs comprising a generally cylindrical body portion having substantially parallel, lateral faces and a transverse opening therethrough;

a headed tie-bolt having a threaded body portion adapted to be mounted through the openings of said lugs to extend therebetween;

thread means associated with said first lug for connective engagement with said threaded body portion whereby tightening of said bolt serves to draw the lugs together into general parallelism to contract said ring, the opening in said second lug being unthreaded for free passage of said body portion therethrough;

teeth means formed unitarily with said second lug comprising arcuate surfaces extending at a slight angle to the lateral faces of said second lug and additional surfaces extending substantially perpendicular to said lateral faces;

said surfaces defining sharp teeth edges at intersections thereof extending outwardly from said lateral faces for frictionally engaging the head of said bolt in a manner permitting threading advancement of said bolt in a tightening direction while substantially resisting dislodgement of said bolt from its tightened position;

conical chamfers formed axially inwardly about the ends of the transverse opening in said second lug;

jam nut threadingly mounted on and moveable over the bolt's said body portion between said lugs;

said jam nut having a conical projection on at least one end thereof for frictionally engaging an opposing one of said chamfers to frictionally lock said jam nut and center said tie bolt coaxially of said opening in said other of said lugs to prevent radial movement of said tie bolt relative to said other of said lugs.

2. The closure assembly of claim 1, wherein said jam nut has planar end faces engaged by said teeth edges when said conical projection is engaged with said one of said chamfers whereby to rotatably lock said nut in a tightened position with said other of said lugs.

3. The closure assembly of claim 1, wherein said thread means are provided within the interior of the opening in said first lug, and the unthreaded opening in said second lug is unthreaded and has a diameter greater than the diameter of the bolt's body portion.

4. The combination of claim 1, wherein the lateral faces of said second lug are formed with axially extending annular shoulders bordering said opening therein, and said teeth means for frictionally engaging the head of said bolt are formed on said shoulders.

5. The closure assembly of claim 1, wherein said ring is metal, and spaced weld ears extend from the body portion of each of said lugs for welded connection with said ring.

6. A closure assembly for removeably securing a cover over the open end of a cylindrical storage drum by a cover engaging split metal ring equipped with a pair of laterally spaced lugs which are interjoined by a headed tie bolt having a threaded body operable to draw the lugs toward one another to contract the ring;

a first one of said pair of lugs comprising a generally cylindrical body portion having a spaced weld ear for securing the lug to the ring and parallel lateral faces for engaging the head of the tie bolt;

said body portion having a central axial opening of a diameter loosely receptive of the tie bolt body for free passage therethrough;

conical chamfers formed to extend axially inwardly of opposite ends of said central opening;

a jam nut threadingly mounted on said tie bolt for movement between said pair of lugs; and an annular cone projecting from at least one end of said jam nut for tightly frictionally engaging an opposing one of said chamfers when said jam nut is tightened against said first lug to co-axially align and prevent radial movement of said tie bolt relative to said central opening.

7. The combination of claim 6, wherein said first lug further includes a plurality of raised projections formed on said parallel lateral faces of said body portion in bordering relation with opposite ends of said central opening, said projections comprising sharp teeth formed and arranged to permit the head of said tie bolt to override said projections when advanced thereagainst by threading movement of said bolt in a tightening direction while materially engaging said head and resisting reverse movement of said bolt.

8. The combination of claim 7, and wherein said jam nut further includes a planar end face extending radially outwardly of said cone on said at least one end for locking engagement with said projections on an opposing lateral face of said first lug.

9. The combination of claim 7, and wherein both ends of said jam nut include an annular cone projecting therefrom.

* * * * *

UNITED STATES PATENT AND TRADEMARK OFFICE

CERTIFICATE OF CORRECTION

PATENT NO. : 5,584,410

DATED : 12/17/96

INVENTOR(S) : Allen D. Siblik

It is certified that error appears in the above-identified patent and that said Letters Patent is hereby corrected as shown below:

Col. 3, line 51, "While", should not be capitalized;

Col. 6, line 28, insert "a" before "pair";

Col. 6, line 57, insert "a" before "jam";

Col. 8, line 21, delete "and".

Signed and Sealed this

First Day of April, 1997

Bruce Lehman

*Attest:*

BRUCE LEHMAN

*Attesting Officer*

*Commissioner of Patents and Trademarks*